US009410271B2

(12) United States Patent
Goenka

(10) Patent No.: US 9,410,271 B2
(45) Date of Patent: Aug. 9, 2016

(54) DECORATIVE ENGINEERED SELF HEM

(71) Applicant: WELSPUN INDIA LIMITED, Mumbai (IN)

(72) Inventor: Dipali Goenka, Mumbai (IN)

(73) Assignee: WELSPUN INDIA LIMITED, Mumbai (IN)

( * ) Notice: Subject to any disclaimer, the term of this patent is extended or adjusted under 35 U.S.C. 154(b) by 0 days.

(21) Appl. No.: 14/525,212

(22) Filed: Oct. 27, 2014

(65) Prior Publication Data

US 2015/0114512 A1 Apr. 30, 2015

(30) Foreign Application Priority Data

Oct. 28, 2013 (IN) ..... 3394/MUM/2013

(51) Int. Cl.

| | |
|---|---|
| ***D03D 25/00*** | (2006.01) |
| ***D03D 5/00*** | (2006.01) |
| ***D05B 1/24*** | (2006.01) |
| ***D05B 35/02*** | (2006.01) |

(52) U.S. Cl.

CPC ..... *D03D 25/00* (2013.01); *D03D 5/00* (2013.01); *D05B 1/24* (2013.01); *D05B 35/02* (2013.01); *D05D 2305/02* (2013.01); *D05D 2305/08* (2013.01)

(58) Field of Classification Search

CPC ..... D05B 35/062; D05B 13/00; D05B 1/24; D05B 35/02; A41D 27/24; A47G 9/10; A47G 9/0253; D03D 5/00; D03D 25/00; D03D 2305/02; D03D 2305/08

See application file for complete search history.

(56) References Cited

U.S. PATENT DOCUMENTS

| | | | | | |
|---|---|---|---|---|---|
| 2,116,339 | A * | 5/1938 | Carter | A47H 23/08 | 112/423 |
| 2,125,422 | A * | 8/1938 | Bosworth | A47H 23/08 | 139/383 R |
| 2,545,970 | A * | 3/1951 | Rand | A47G 9/0253 | 5/490 |
| 4,149,275 | A * | 4/1979 | Sanchez | A41D 1/06 | 2/269 |
| 4,621,585 | A * | 11/1986 | Ball | D05B 33/00 | 112/10 |
| 2005/0235420 | A1 | 10/2005 | Keith | | |
| 2010/0282359 | A1* | 11/2010 | Rabin | D03D 15/00 | 139/396 |
| 2010/0306920 | A1 | 12/2010 | Balasundharam | | |
| 2011/0302714 | A1* | 12/2011 | Martenson | A47G 9/00 | 5/482 |
| 2015/0007388 | A1* | 1/2015 | Harrison | D06P 5/02 | 5/490 |

* cited by examiner

*Primary Examiner* — Ismael Izaguirre

(74) *Attorney, Agent, or Firm* — Tillman Wright, PLLC; Chad D. Tillman; Jeremy C. Doerre

(57) ABSTRACT

A decorative engineered self-hem and a method to prepare the decorative engineered self-hem in a single fabric is disclosed herein. It is prepared without having any additional cut and sew, with various weave patterns designed in a design area 10-20 inches from a selvedge area and the rest of the fabric is woven in conventional weave pattern such as satin/twill. The method of preparation includes cutting the fabric parallel to a selvedge area; folding the fabric overlapping the selvedge area; and folding the full fabric horizontally and, at the same time, hemming of edge of the selvedge area to finish.

20 Claims, 3 Drawing Sheets

DECORATIVE ENGINEERED SELF HEM

CROSS-REFERENCE TO RELATED APPLICATION

The present application claims foreign priority under 35 U.S.C. 119 to patent application 3394/MUM/2013, filed in India on Oct. 28, 2013, which patent application is incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE INVENTION

The present invention generally relates to a novel textile fabric. More particularly, the present invention relates to a single textile fabric with a decorative engineered self-hem, wherein the decorative hem is a part of the fabric, and wherein the decorative hem it is not achieved by sewing or joining of another fabric. The fabric is used as and forms a sheet, one or more sheets of a sheet set, one or more components of bedding, and the like, for example.

BACKGROUND OF THE INVENTION

A hem in sewing is a garment finishing method, where the edge of a piece of cloth is folded narrowly and sewn to prevent unravelling of the fabric. In a most common hemming method, a cut edge is folded and is then sewn. With this method, the cut edge is completely enclosed in the cloth so that it cannot unravel. Three basic forms of hems can be used in the process of constructing garments: turned-up edge, faced edge, and enclosed edge. The most common technique used is the turned-up edge hem. After the hem is constructed, the following criteria should be met: 1) the garment should hang on the body in a uniform and even manner; 2) the hem should be free of bulk, and 3) the hem should be concealed from the eye unless used for decorative purposes. Generally, the hem is done at the edge of the fabric or near a selvedge area. The selvedge area is a self-finished edge of fabric.

The most important attributes of any bedding items are the look and design of the product. To enhance the beauty of bed linen, many embellishments are generally done on the hem thereof. In market almost all flat sheets, pillow cases, cushions, duvet covers, etc., are embellished with one or more designs, different cut and sew styles, or both, by joining different fabric to hem or by embroidery in then hem. Lot of designs or embellishments increase costs and cause additional duty on the products in the United States. Furthermore, due to embellishments, additional skill sets are required in cut and sew operations and production efficiencies are reduced.

In recent times fabrics have been prepared by stitching two different materials at a distance of 5-10 inches from the selvedge area in order to provide an aesthetic appearance. However, the same involves huge costs as it involves two different materials, and additional cutting and sewing steps. Moreover, the same involves additional import duty on the product in United States.

CN102524993 discloses a method for processing a hem of a men's suit, which includes the steps of: firstly, cutting a back hem interlining according to size designation of the suit and using twill hair interlining strips 5-7 cm in width; secondly, aligning the hem interlining with a hem fold notch, allowing the lower end of the hem interlining to be parallel to the hem, and allowing two ends of the hem interlining to be 0.3-0.4 cm away from a slit fold point; thirdly, straightening out the hem interlining, uniformly basting three lines to fasten the hem interlining; performing blindstitch to evenly sew three lines close to the basted lines to hold the hem interlining; fourthly, stitching the slit, press-opening the slit, and fold-ironing the hem edge 4-5 cm; and fifthly, sewing up the shell and the lining of a back slit, basting to fasten the hem edge, and performing blindstitch to fasten the hem edge 0.7-1.5 cm away from a rough selvedge. The hair interlining strips are used in the method to substitute nonwoven interlinings, the hem of the made suit is linear and soft to touch, and naturally fits a human body.

In view of the foregoing, a need in the art is belied to exist for providing a self-engineered hem that is capable of overcoming one or more of the above issues while yet providing an excellent and smart look to the product, especially where this is provided through a simple process for preparing the same without additional cut and sew steps.

SUMMARY OF THE INVENTION

In an aspect of the present invention, a single fabric comprises a decorative self-hem located a distance of 10 to 20 inches from a selvedge area of the single fabric. In a feature, the fabric includes one or more various weave patterns.

In another aspect, a method comprises making the decorative engineered self-hem in a single piece of fabric. The method comprises a first step of cutting a piece of fabric along a cut line that is parallel to an edge of a selvedge area; a second step of folding the fabric overlapping the selvedge area; and a third step of folding the fabric horizontally and at the same time, hemming of edge of the selvedge area to finish, wherein the resulting self-engineered hem is designed during weaving without having any additional cut and sew. Using the above method, various weave patterns are designed 10-20 inches from the selvedge area and the rest of the fabric is woven in conventional weave pattern such as satin/twill/Percale/Oxford.

In a preferred embodiment, the fabric is woven by creating a design in a range 10-15 inches from the selvedge area of the fabric, and the rest of the fabric is woven using a conventional method. The fabric is then processed and finished, and then cut and sewn in a way that the hem is created in a preferred range of 4 to 6 inches from the edge area of the sewn product.

BRIEF DESCRIPTION OF THE DRAWINGS

One or more preferred embodiments of the present invention now will be described in detail with reference to the accompanying drawings, wherein the same elements are referred to with the same reference numerals.

DETAILED DESCRIPTION

Figure 1:
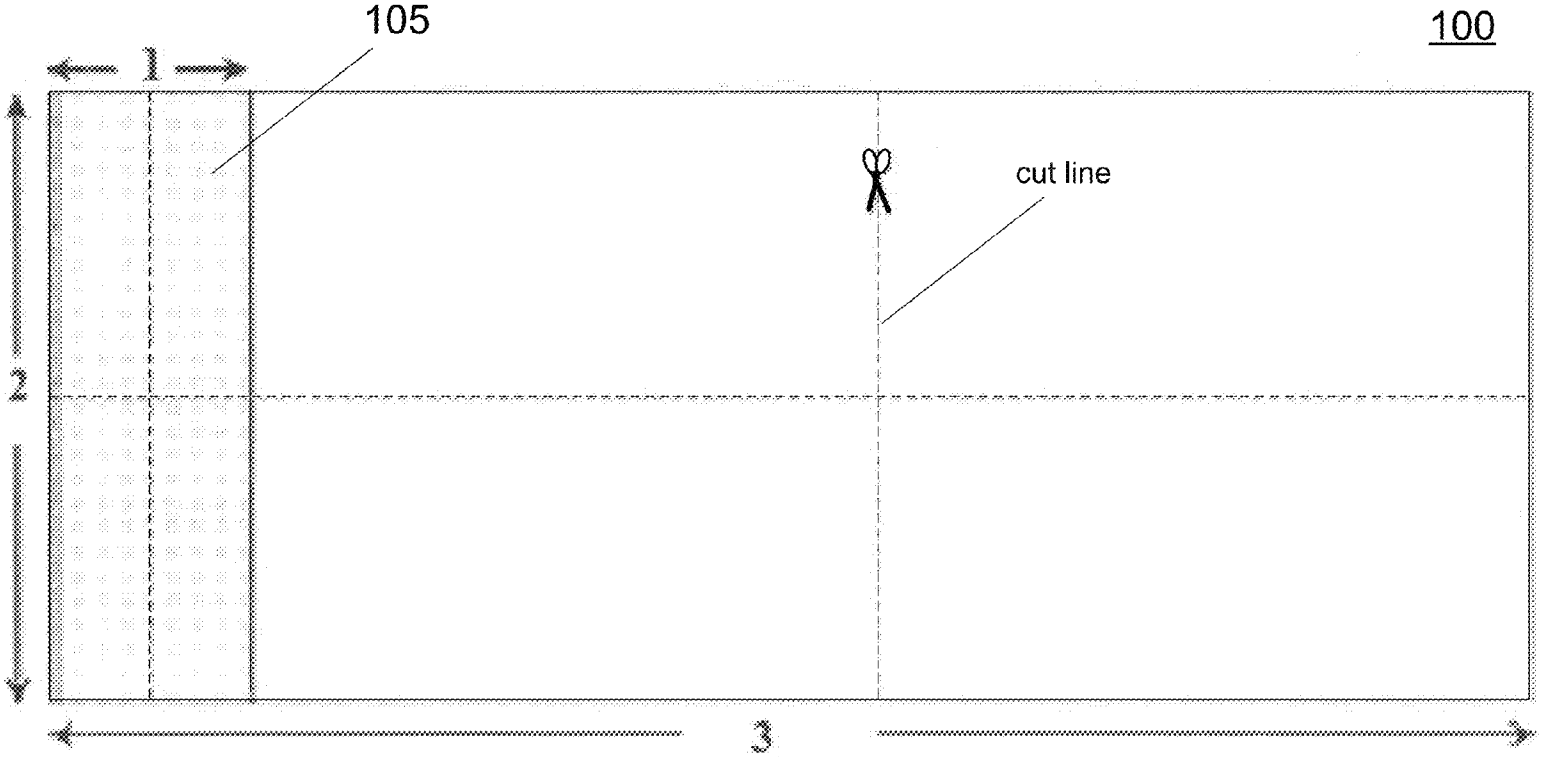
FIG. 1 illustrates a single piece of fabric from which a product having a self-engineered hem is made by cutting, folding, and sewing in accordance with a preferred embodiment of an aspect of the invention, wherein FIG. 1 further illustrates a cutting step.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. 112, paragraph 6 or subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
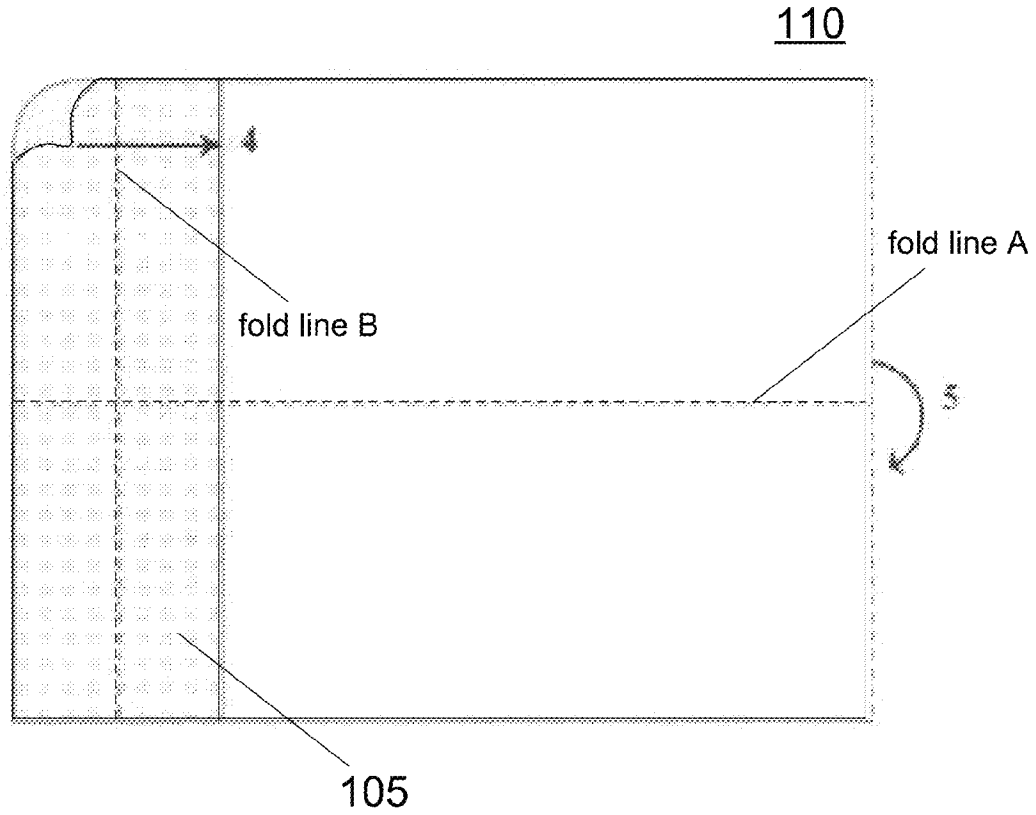
FIG. 2 illustrates steps of folding and sewing a fabric piece cut from the piece of fabric shown in FIG. 1, in accordance with a preferred embodiment of an aspect of the invention.
Figure 3:
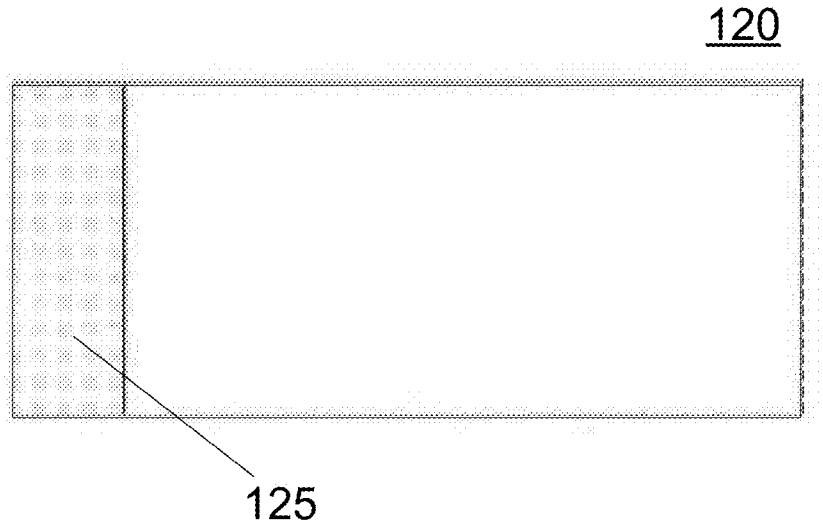
FIG. 3 illustrates the resulting product of the illustrated steps, wherein the product has a self-engineered hem with design made during manufacture of the piece of fabric of FIG. 1.

Turning now to FIGS. 1-3, a preferred decorative engineered self-hem and a preferred method to prepare the decorative engineered self-hem in a single fabric is disclosed.

Accordingly, in a preferred embodiment, the invention provides a self-engineered hem that is designed during weaving without having any additional cut and sew operation in creating the design of the hem. During weaving of sheeting fabric, mills generally do the weaving in different patterns like satin, twill, percale, oxford, etc.; however, in accordance with preferred aspects of the invention, various weave patters are provided 10-20 inches from the selvedge area, and the rest of the fabric is woven in conventional weave pattern like Percale/Oxford/satin/twill. After processing and finishing of the fabric, the cut and sew is performed in such a manner that the hem is created from the 10-20 inches of the fabrics which was woven in different design from the remainder of the fabric.

The fabric can be constructed with a plurality of warp yarn and a plurality of weft yarn. Hence, the present invention provides products comprising embellished flat sheets, pillow covers, shams, cushions/cushion covers, duvet covers, table covers, curtains and other bedding products with exceptional new creative looks and patterns.

In a preferred embodiment, the fabric is 100% cotton woven and can be done in any fiber or any blend, woven satin or any weave in the body, wherein 10-20 inches from the selvedge side are woven with a different weave/design pattern. The fabric is preferably constructed with 60 s warp yarn and 60 s count weft yarn and final thread count is 300, but can be done in 40 s, 60 s, 80 s, 100 s, 120 s yarn count and thread count of 200 TC and above. However, the yarn count stated here is for exemplary purposes and does not by virtue hereof restrict the broadest scope of the invention as defined in any claim that may issue.

FIGS. 1-3 represent steps of the decorative engineered self-hem of the present invention. In this respect, FIG. 1 shows a fabric 100 having a width 3 and including a selvedge area 105 having a width 1 and length 2. The selvedge area includes a design that is different from the design of the remainder of the fabric 100, which differing designs are provided during the making of the fabric, preferably by weaving.

As illustrated in FIG. 1, the fabric is cut along a cut line, with a resulting portion of fabric 110 shown in FIG. 2 that has the selvedge area 105 being folded along a fold line A in the direction of arrow 5, and an edge 4 of the selvedge area 105 being folded along fold line B and sewn as a hemming step. Having completed this, the final product 120, which is rectangular in shape and includes resulting hem 125, is created as illustrated in FIG. 3.

In another preferred embodiment of a process for preparation of a self-engineered hem, after weaving the fabric with the differing areas of patterns as described above, for example, the fabric is processed in a conventional process route. Before stitching the fabric is cut as per required dimension, i.e., as per required product size. The "S" hem sewing technique is done after making the innovative designing on the hem area. The process further includes conventional singeing and desizing, desizing wash, pretreatment, mercerization, dyeing and finishing.

Accordingly, a preferred method to prepare a decorative engineered self-hem in a single fabric comprises a first step of cutting the fabric parallel to a selvedge area; a second step of folding the fabric overlapping the selvedge area; and a third step of folding the full fabric horizontally and at the same time, hemming of edge of the selvedge area to finish, wherein the resulting self-engineered hem is designed during weaving without having any additional cut and sew steps in creating the design of the hem.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method of preparing a decorative engineered self-hem in a single fabric, comprising: making a first pattern in an area of the single fabric defining a selvedge area and not making the first pattern in the rest of the fabric; cutting the fabric parallel to the selvedge area; folding the fabric in the selvedge area; folding the fabric along a fold line extending a full length of the cut fabric including through the selvedge area; and hemming an edge of the selvedge area without any additional cut and sew to thereby create the decorative engineered self-hem in the single fabric.

2. The method of claim 1, wherein a second pattern is made in the rest of the fabric, the second pattern being different and visually distinguishable from the first pattern.

3. The method of claim 1, wherein the first pattern creates a visually distinguished area from the rest of the fabric so as to visually define the area of the resulting hem from the rest of the fabric.

4. The method of claim 1, wherein the first pattern is made by weaving.

5. The method of claim 4, wherein a second pattern is woven in the rest of the fabric, the second pattern being different and visually distinguishable from the first pattern.

6. The method of claim 5, wherein the second pattern comprises a weaver pattern such as satin/twill.

7. The method of claim 1, wherein the selvedge area defined in the fabric extends 10-20 inches from an edge of the fabric.

8. The method of claim 1, wherein said fabric is constructed with a yarn count between 40 s and 120 s.

9. The method of claim 1, wherein the thread count of the fabric is 200TC or above.

10. The method of claim 1, wherein the fabric comprises a plurality of warp yarn and weft yarn.

11. A method of preparing a decorative engineered self-hem in a single fabric, comprising: making a first pattern in an area of the single fabric defining a selvedge area and not making the first pattern in the rest of the fabric; cutting the fabric parallel to the selvedge area; folding the fabric in the selvedge area and thereafter folding the fabric along a fold line extending a full length of the cut fabric including through the folded selvedge area; and hemming an edge of the selvedge area without any additional cut and sew to thereby create the decorative engineered self-hem in the single fabric.

12. The method of claim 11, wherein the first pattern is made by weaving.

13. The method of claim 11, wherein the selvedge area defined in the fabric extends 10-20 inches from an edge of the fabric.

14. The method of claim 11, wherein said fabric is constructed with a yarn count between 40 s and 120 s.

15. The method of claim 11, wherein the thread count of the fabric is 200TC or above.

16. A method of preparing a decorative engineered self-hem in a single fabric, comprising: making a first pattern in an area of the single fabric defining a selvedge area and not making the first pattern in the rest of the fabric; cutting the fabric parallel to the selvedge area; folding the fabric along a fold line extending a full length of the cut fabric including through the selvedge area; folding the fabric in the selvedge area; and hemming an edge of the selvedge area without any additional cut and sew to thereby create the decorative engineered self-hem in the single fabric.

17. The method of claim 16, wherein the first pattern is made by weaving.

18. The method of claim 16, wherein the selvedge area defined in the fabric extends 10-20 inches from an edge of the fabric.

19. The method of claim 16, wherein said fabric is constructed with a yarn count between 40 s and 120 s.

20. The method of claim 16, wherein the thread count of the fabric is 200TC or above.

* * * * *